United States Patent [19]

Larsen et al.

[11] 4,366,631

[45] Jan. 4, 1983

[54] ATHLETIC SHOE

[75] Inventors: John E. Larsen, Hingham; Rob R. McGregor, Concord, both of Mass.

[73] Assignee: Colgate-Palmolive Company, New York, N.Y.

[21] Appl. No.: 225,171

[22] Filed: Jan. 15, 1981

Related U.S. Application Data

[63] Continuation of Ser. No. 21,366, Mar. 19, 1979, Pat. No. 4,245,408.

[51] Int. Cl.[3] ..... A43B 11/00; A43B 23/28; A43B 5/00

[52] U.S. Cl. ..... 36/50; 36/58.5; 36/114

[58] Field of Search ..... 36/50, 58.5, 114, 129, 36/83; 24/117 R, 140

[56] References Cited

U.S. PATENT DOCUMENTS

| | | | |
|---|---|---|---|
| 752,173 | 2/1904 | Manss | 36/50 |
| 859,382 | 7/1907 | Hansen | 36/129 |
| 1,668,120 | 5/1928 | McLaren | 36/50 |
| 2,806,300 | 9/1957 | Morgan et al. | 36/129 X |
| 3,138,880 | 6/1964 | Kunzli | 36/114 |

FOREIGN PATENT DOCUMENTS

| | | | |
|---|---|---|---|
| 254222 | 7/1926 | United Kingdom | 36/50 |
| 261090 | 11/1926 | United Kingdom | 36/83 |
| 329451 | 5/1930 | United Kingdom | 36/50 |

*Primary Examiner*—Patrick D. Lawson

*Attorney, Agent, or Firm*—Herbert S. Sylvester; Murray M. Grill; John A. Stemwedel

[57] ABSTRACT

There is disclosed an athletic shoe that finds most efficacy with joggers. The shoe is supplied with a conventional upper and sole. The usual lacing arrangement is provided with the exception that additional lacing means is provided along both sides of the shoe whereby the counter containing heel portion of the shoe is constrained in a manner so that the heel portion of the athletic shoe is brought inward in the direction of the centerline of the shoe to effectively lock the heel portion with the front portion. The tying arrangement may be a continuation of the usual lacings or may be two separate laces, but in any event essentially locks the front and back of the shoe together. The lace arrangement extending to the counter or heel portion is positioned whereby the means is substantially parallel to a "spring" ligament as normally located in the foot.

3 Claims, 7 Drawing Figures

ATHLETIC SHOE

This is a continuation of application Ser. No. 21,366 filed Mar. 19, 1979, U.S. Pat. No. 4,245,408.

BACKGROUND OF THE INVENTION

The athletic shoes utilized by joggers, for instance, are usually low cut for a variety of valid reasons. Conventionally constructed shoes have an inherent hazard in active sports in that the shoes are liable to slip off unexpectedly under unusual stresses. It is desirable to prevent or minimize slipping of the shoe off the foot. While it is true that straight forward jogging may not inflict such undue stresses, it is still a problem, especially with some individuals who possess somewhat diminutive heels in relationship to the forward foot width.

SUMMARY OF THE INVENTION

The present invention relates to an athletic shoe, especially, useful for joggers but by no means is limited to such use. A conventional jogging shoe is provided with means for attaching a tying means to the forwardly extending counter portion of an athletic shoe and in one embodiment a guide loop at the rear of the shoe whereby the counter portion of the shoe is pulled forward and slightly upwardly as the tying is completed by integration with the conventional lacing means, in one embodiment, at the uppermost eyelets normally found in a conventional shoe. In another embodiment two separately tied laces are employed wherein there is also included a literal block and tackle arrangement to move the counter portion inwardly. The positioning of the aforementioned typing arrangement is important and has been found desirable to be somewhat substantially parallel to the "spring" ligament of the foot.

PRIOR ART

Prior art workers have disclosed some attempts in providing tying arrangements to produce a rear to front locking arrangement, but have not disclosed the instant concept.

Bovay in U.S. Pat. No. 3,234,667 disclosed a shoe which has a strap that is integral with both sides of a shoe wherein the strap extends back to the end of the lowermost portion of the heel from the uppermost eyelet containing portion. However, the strap is not adjustable nor is any forward tension applied as the lacing and tying is accomplished.

Similarly, Kunzli in U.S. Pat. No. 3,138,880 provides a strap which is sewn in place. The strap merely encircles the heel and is not in a position to apply lock in stress for the front and back of the foot.

Finally, the U.S. Pat. to Gatti No. 3,703,775 is to an athletic shoe provided with a tying means from the front but as the lacing is merely knotted on the back of the heel there is merely a squeezing of the opening to the shoe through which the ankle/leg extends.

It will be seen from the detailed consideration that the present invention provides decided advantages whereby the front and rear portions of a foot are more securely locked so that the jogger feels more secure that his foot is more integral with the shoe and is also afforded protection from injury.

Accordingly, one form of the athletic shoe according to the present invention will now be described in greater detail, by way of example only, with reference to the accompanying drawings.

DETAILED DESCRIPTION OF THE PREFERRED EMBODIMENT OF THE INVENTION

Figure 1:
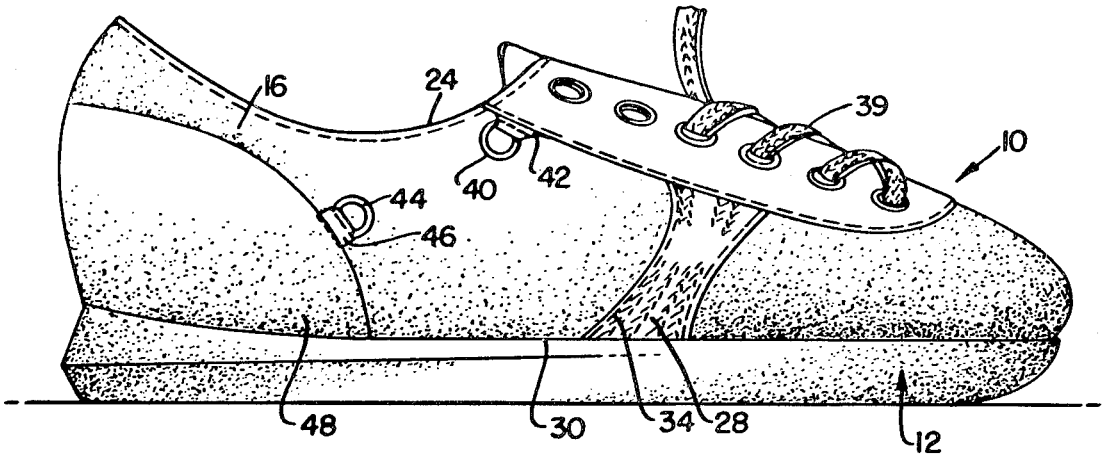
FIG. 1 is a side elevational view of the shoe of the present invention where the shoe has been partially laced.

Turning now to the drawings the athletic shoe illustrated thereby includes an upper 10 and a sole 12. The shoe shown is of the style worn for walking and running so that a fairly heavy impact absorbing sole is depicted. The upper 10 and sole 12 may be secured together in any convenient manner; that is, they may be nailed, stitched or cemented together or be attached by any combination of these methods. The particular method used for attaching the parts is not part of the present invention.

The upper 10 is shown in the drawings to have a vamp 16 preferably made of one piece so that it is a full vamp but the vamp may be a three-quarter vamp or merely a circle vamp. The rear edges of the vamp are sewn together at the rear seam 20. A rather wide eyelet opening 22 is provided which is surrounded by a generally U-shaped reinforcing margin 32 and which extends from the top edge 24 to the toe region 26 having a conventional tongue 19 below.

In the drawing a pair of wide side straps 28 is shown to extend generally parallel to one another from the lasting margin 30 of the upper to the said reinforcing margin 32 of the eyelet opening 22. The straps 28 are secured to the outer surface of the upper, and they are all stitched to the upper throughout their entire length as suggested by the seams 34. As depicted, the lower ends of the straps 28 are stitched to the lasting margin and lie beneath the sole 12 and therefore each is firmly stitched to the upper and will not part from it.

The reinforcing margin 32 is provided with a plurality of paired eyelet openings 36 which may have conventional grommets 38. In the embodiment herein being discussed it has been found efficacious to employ six pairs of eyelets grommeted openings 36 and when the ends of the laces are pulled with appreciable force to tighten the shoe upper about the foot the stress is distributed evenly over the entire sides of the shoe upper from the margin 30 to the reinforcing margin 32 by virtue of the connection between the reinforcing margin and the sides. The foregoing pertains to a conventional arrangement which therefore will be well understood.

The present invention is an improvement of the prior art as enumerated in the foregoing. It has been found valuable to secure snugly the rearward portion of the shoe in a like manner as is accomplished with a conventional laced front portion as discussed in the above. To achieve this salutary effort, it is contemplated within the purview of the invention to secure two D-shaped eyelet rings by means of straps along a predetermined portion of each side of the shoe. As FIG. 1 depicts the inwardly or instep side it will be noted that a D-shaped eyelet 40 is secured to a downwardly facing edge of the reinforcing margin 32 near top edge 24 by means of a relatively short folded over strap 42, the edge portions of which are secured in place by being stitched between the upper and the reinforcing margin 32. It is within the purview of the present invention to attach the D-shaped eyelet 40 by any other suitable means as long as the means therefor provide a secure connection. The said D-shaped eyelet 40 acts as a guide means.

On the same side of the shoe as mentioned in the above another D-shaped eyelet 44 is secured to the side of the shoe. The eyelet is attached by means of relatively short folded over strap 46, the edge portions of which are secured in place by being suitably stitched between an edge portion of a counter piece 48 which is laid over the vamp and is stretched in place in a manner to also securely capture the folded over strap 46. In the present embodiment it will be noted that a conventional counter may also be positioned internally of the vamp. As long as strap 46 is secured to the counter or counters utilized directly or indirectly the purposes of the invention may be readily achieved.

Similarly the other side or outer portion of the shoe is provided with suitably secured D-shaped eyelet secured in like manner as eyelet 40 for the same purpose of acting as a guide. Furthermore, a D-shaped eyelet 52 is provided which is suitably secured to the other side of the counter in like manner as D-shaped eyelet 44, i.e., at the edge portion thereof.

As stated the aforementioned eyelet 40 is used as guide means for lace 39 to provide a guide means for properly directing the lace 39 downwardly at a preselected angle towards D-shaped eyelet 44 around which the lace is looped and is directed back through eyelet 40 and through the uppermost eyelet located conventionally in the reinforcing margin 32. In order to more easily accommodate the double threading therethrough of the lace, the uppermost pair of grommeted eyelets may provide larger openings then the other pairs.

Figure 2:
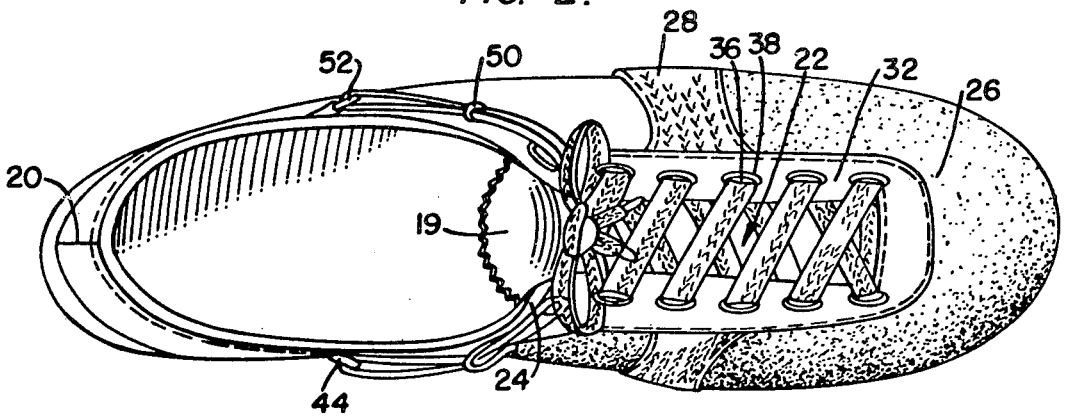
FIG. 2 is a top plan view of the shoe of the present invention.

The other end of the lace 39 is threaded in a like manner through guiding D-shaped eyelet 50 and looped around eyelet 52 and played back to the other uppermost grommeted eyelet located in the reinforcing margin 32. It will be noted that FIGS. 2 and 3 demonstrate quite clearly the manner in which the lace is threaded.

Figure 3:
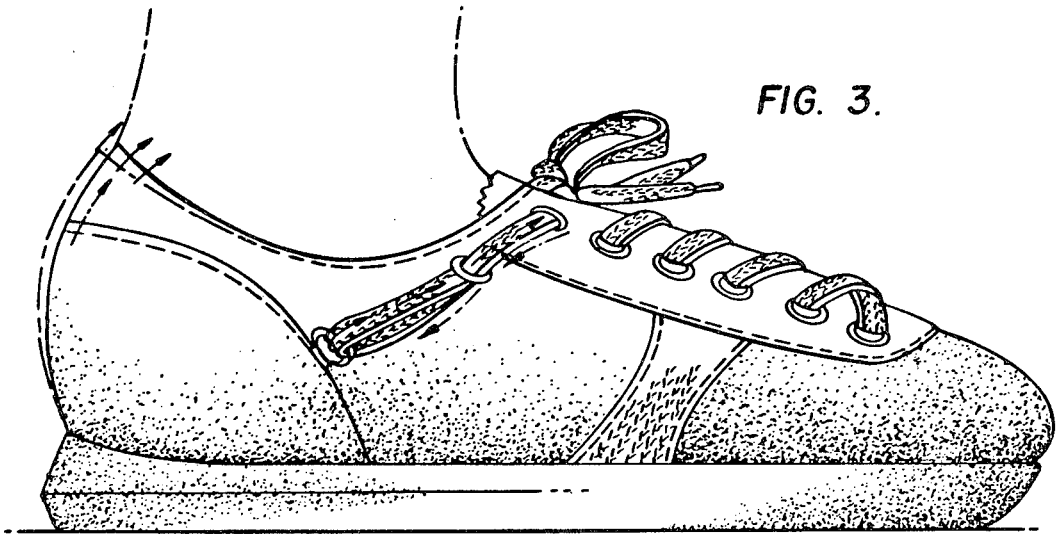
FIG. 3 is a side elevational view of the shoe as in FIG. 1 with the laces in position and tied.
Figure 4:
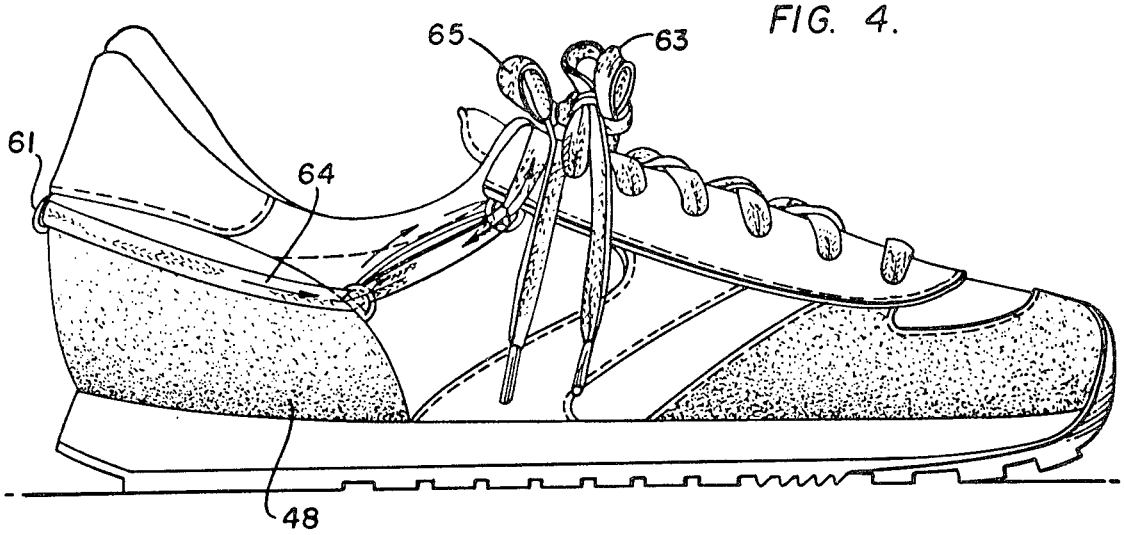
FIG. 4 is a side elevational view of another embodiment of the shoe of the present invention.
Figure 5:
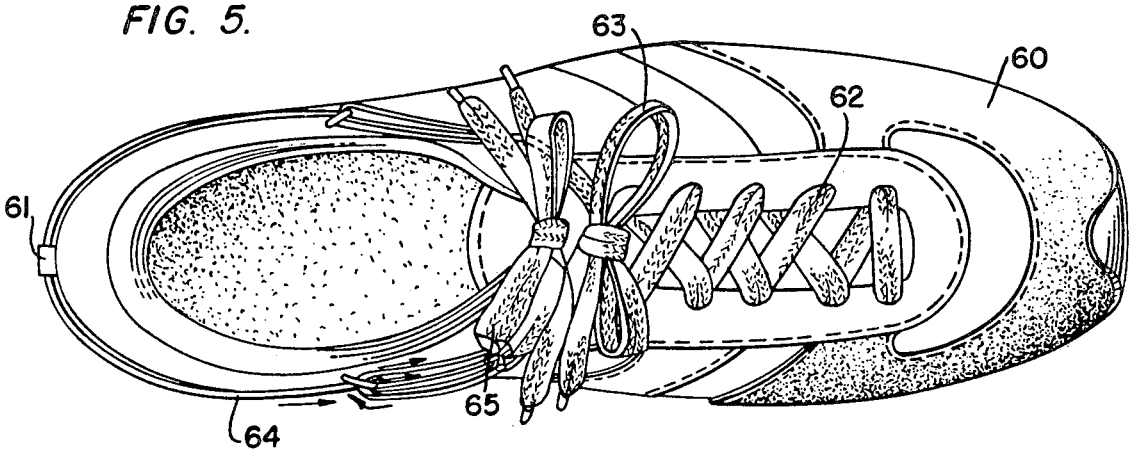
FIG. 5 is a top plan view of the embodiment of FIG. 4.
Figure 6:
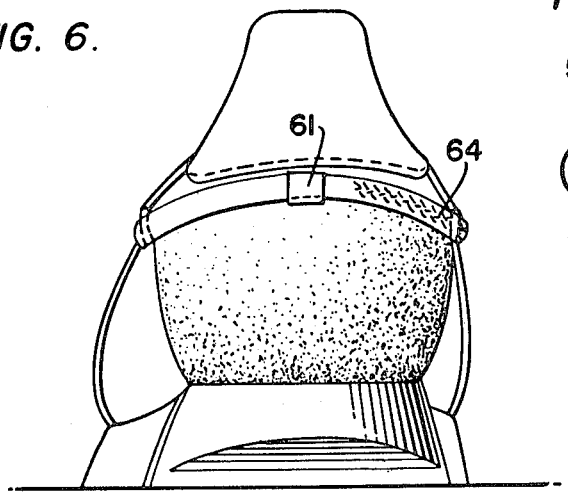
FIG. 6 is a rear elevational view of the embodiment of FIG. 4.

Prior to producing a conventional bow type knot, the ends of the lace are again pulled with considerable force to tighten or pull the heel portion of the shoe in the direction shown by the arrows in FIG. 3. There is thus provided a means of assisting the holding of the shoe on the foot. It has been found that the positioning of the D-shaped eyelets especially D-shaped eyelets 44 and 52 along the sides of the shoe in fact controls the usefulness afforded by the pulling affect or hugging effect of the movement of the heel portion. The resultant can be said to provide, as stated a heel lock. It has been discovered the shoes fitted with orthodics sit better on the heel of the user when fitted with the heel lock arrangement of the present invention.

The lace employed can be of an elongated elastic type whereby the tension supplied may be lessened in the event of undue stress conditions. Such a lace arrangement eliminates the cutting into of the foot as would result when a non-elastic lace is employed.

The positioning of the D-shaped eyelets 44 and 52 have been selected to not only control the counter as hereinbefore stated but also to provide a lace position that possess a relationship to an important ligament found in the foot. The ligament is the plantar calcaneonavicular. It is a broad and thick band of fibers which connects the anterior margin of the sustentaculum tali of the calcaneus to the plantar surface of the navicular. The ligament not only serves to connect the calcaneus and navicular, but supports the head of the talus, forming part of the articular cavity in which it is received. The dorsal surface of the ligament presents a fibrocartilaginous facet, lined by the synovial membrane, and upon this a portion of the head of the talus rests. Its plantar surface is supported by the tendon of the Tibialis posterior; its medial border is blended with the forepart of the deltoid ligament of the ankle joint.

The ligament is principally concerned in maintaining the arch of the foot. When it yields, the head of the talus is pressed downward, medialward and forward by the weight of the body, and the foot becomes flattened, expanded, and turned lateralward, and exhibits the condition known as flat-foot. The ligament contains a considerable amount of elastic fibers, so as to give elasticity to the arch and spring to the foot; hence it is sometimes called the "spring" ligament. The positioning of the ligament is such that it is also protected from undue stretching. The positioning of the lace should be somewhat if not essentially parallel to the spring ligament to obtain the optimum control.

While in the foregoing the locking arrangement is accomplished by using the lace as a continuation of the tying means. It is contemplated within the purview of the invention to employ separate laces or straps or buckles, or the like, at each side of the shoe to apply tension between the laced portion of the shoe and the heel.

Now, attention is directed to FIGS. 4 to 7 for a review of another useful embodiment of the present invention. The shoe of this embodiment is somewhat similar as before, but it will be noted that the forwardly extending vamp has a toe cap 60. Similarly, each side of the shoe is provided with D-shaped eyelets 40 and 44 on one side and D-shaped eyelets 50 and 52 on the other side. The D-shaped eyelets are secured in the same manner as in connection with the other embodiment. In addition to the aforementioned D-shaped eyelets a loop 61 is provided at the heel which in the disclosed embodiment is a folded over short strap whose edges are sandwiched between the counter piece 48 and the rear vamp when the counter piece is sewn to the vamp. The shoe of this embodiment is provided with two laces. A conventional lace 62 is provided and is threaded through conventional holes in the eyelet portion terminating in a conventional bow 63. A second lace 64 is first played through loop 61 so that it is appropriately centered and equal portions of the lace 64 are on each side of the loop.

Figure 7:
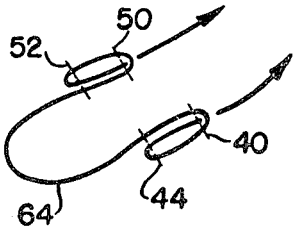
FIG. 7 is a diagrammatic view of the lacing arrangement of the embodiment of FIG. 4.

For a succinct review of the manner of lacing, attention is specifically directed to FIG. 7. One end portion of lace 64 is then guided through D-shaped eyelet 44, then up to D-shaped eyelet 40, and then back down around and through D-shaped eyelet 44 and finally back up through D-shaped eyelet 40 in the direction of the eyelet opening 22. Similarly, the other and of the lace 64 is played through D-shaped eyelet 52, then up to D-shaped eyelet 50 and then back down through D-shaped eyelet 52 and finally back up through D-shaped eyelet 50. The two ends of the lace 64 are brought together over the uppermost portion of the eyelet opening where a bow 65 is completed.

The threading of the lace on both sides of the shoe through the D-shaped eyelet clearly provides for a sort of block and tackle arrangement resulting in the drawing together of the counter portion with the forward portion.

It is reiterated that the arrangement above-disclosed is to make the heel part of the shoe conform more closely to the anatomical heel than it would under normal circumstances. It should be seen that this is achieved by the block and tackle arrangement between the D-shaped rings on either side of the shoe. With the two-to-one mechanical advantage generated by the block and tackle, the counter is effectively pulled inward and upward. This motion, which is individually adjustable, both as to tension and as to size, keeps the heel of the jogger from slipping in the lateral to medial direction. It will be appreciated that this is very important because in jogging this laterial to medial slippage is identified with injuries. Primarily, the forces are generated between the D-shaped rings.

Since the counter is made to conform more closely to the anatomical foot, heel slippage up and down is minimized also. Other advantages may readily be contemplated. For instance, the narrow heel, which occurs particularly in women, is more accurately accommodated by the shoe. Another advantage is found when an orthodic device is employed. An orthodic device is used by some runners to correct problems in the anatomical foot. The device is typically placed in the bottom of the shoe, thereby taking up a vertical dimension, and, as a result, the shoe provides less counter and back support. Individuals who wear orthodics need shoes with additional height or run with the feeling of heel slippage. The lacing arrangement of the present invention advantageously retains the foot in position.

It should also be pointed out that the materials of construction for the various parts of the shoe are selected from conventional natural and synthetic materials.

The foregoing description will suggest modifications of the present invention to one familiar with the art of shoe making. Because numerous modifications may be made of this invention without departing from its spirit, it is not intended that the breadth of this invention be limited to the specific embodiments illustrated and described. Rather, it is intended that the scope of this invention be determined by the appended claims and their equivalents.

What is claimed is:

1. An athletic shoe comprising:

(a) a sole;

(b) an upper affixed to the sole having a toe portion, a heel portion and a connecting portion therebetween;

(c) said heel portion having a heel portion embracing counter means having a forwardly extending portion at each side of the heel portion and a rearward portion;

(d) said shoe having a upwardly facing opening in said upper having an edge, through which the ankle portion of a foot protrudes when said shoe is worn;

(e) an eyelet-containing substantially U-shaped portion in said connecting portion extending from proximately rearward of said toe portion to said edge of said opening of said upper and having a row of spaced eyelets in each of said legs of said U-shaped portion by means of which said shoe is laced and tied;

(f) a first ring connecting means affixed to the forwardly extending portions of said counter means at each side of the upper;

(g) a second ring connecting means affixed to said U-shaped portion near said edge of said opening of said upper;

(h) an elongated lace having a portion threaded through said eyelets in said U-shaped portion and one end portion of the lace is threaded through said second ring connecting means, thereafter is threaded through said first ring connecting means and then again is threaded through said second ring connecting means all on the same side of the shoe; and the other end portion of the lace is threaded through said second ring connecting means, thereafter is threaded through said first ring connecting means and then again is threaded through said second ring connecting means all on the other side of the shoe, (i) the lace is of sufficient length whereby there are end portions capable of being tied over the top portion of the U-shaped eyelet portion to thereby produce drawing together stress between the first ring connecting means and the top portion of the U-shaped eyelet portion at each side of the shoe.

2. The shoe of claim 1 wherein the ring connecting means are metal rings.

3. The shoe of claim 2 wherein the ring means are affixed by loops sewn to said shoe.

* * * * *